US009855478B2

(12) United States Patent
Polig

(10) Patent No.: US 9,855,478 B2
(45) Date of Patent: Jan. 2, 2018

(54) TRAINING APPARATUS, IN PARTICULAR FOR CLIMBING

(71) Applicant: Vertical-Life SRL, Bressanone (IT)

(72) Inventor: Matthias Polig, Racines (IT)

(73) Assignee: Vertical-Life SRL, Bressanone (IT)

( * ) Notice: Subject to any disclaimer, the term of this patent is extended or adjusted under 35 U.S.C. 154(b) by 0 days.

(21) Appl. No.: 15/030,642

(22) PCT Filed: Oct. 21, 2014

(86) PCT No.: PCT/EP2014/002836

§ 371 (c)(1),
(2) Date: Apr. 20, 2016

(87) PCT Pub. No.: WO2015/058850

PCT Pub. Date: Apr. 30, 2015

(65) Prior Publication Data

US 2016/0243422 A1 Aug. 25, 2016

(30) Foreign Application Priority Data

Oct. 23, 2013 (IT) ..... BZ2013A0052

(51) Int. Cl.
*A63B 21/00* (2006.01)
*A63B 23/12* (2006.01)
(Continued)

(52) U.S. Cl.
CPC .... *A63B 69/0048* (2013.01); *A63B 21/00047* (2013.01); *A63B 23/12* (2013.01);
(Continued)

(58) Field of Classification Search
CPC ... A63B 21/00047; A63B 23/12; A63B 23/16; A63B 69/0048
See application file for complete search history.

(56) References Cited

U.S. PATENT DOCUMENTS 5,092,587 A * 3/1992 Ulner ..... A63B 69/0048 248/925
5,125,877 A * 6/1992 Brewer ..... A63B 69/0048 482/37
(Continued)

FOREIGN PATENT DOCUMENTS

DE 102005051326 A1 4/2007
DE 102006029309 A1 12/2007
(Continued)

OTHER PUBLICATIONS

International Search Report PCT/ISA/210 for International Application No. PCT/EP2014/002836 dated Feb. 11, 2015.
(Continued)

*Primary Examiner* — Loan H Thanh
*Assistant Examiner* — Jennifer M Deichl
(74) *Attorney, Agent, or Firm* — Harness, Dickey & Pierce, P.L.C.

(57) ABSTRACT

A training apparatus is attached to a hangboard, equipped with differently-shaped grips (projecting parts or recesses). The hangboard is vertically moveable in a supporting element at a wall or at a permanent fixed structure and this supporting element is equipped with an element or a protruding flange acting as the lower end-stop for the moveable hangboard. Springs or elastic elements act between the fixed supporting element and the hangboard to press or pull the hangboard upwards.

11 Claims, 2 Drawing Sheets

(51) Int. Cl.
*A63B 69/00* (2006.01)
*A63B 71/06* (2006.01)

(52) U.S. Cl.
CPC ..... *A63B 71/06* (2013.01); *A63B 2071/0694* (2013.01); *A63B 2220/801* (2013.01); *A63B 2220/833* (2013.01); *A63B 2225/50* (2013.01)

(56) References Cited

U.S. PATENT DOCUMENTS 5,328,422 A * 7/1994 Nichols ..... A63B 22/001 482/111
5,352,166 A * 10/1994 Chang ..... A63B 69/0048 482/37
5,549,195 A * 8/1996 Aulagner ..... A63B 69/0048 198/850
5,732,954 A 3/1998 Strickler et al.
5,919,117 A * 7/1999 Thompson ..... A63B 22/02 198/850
6,083,142 A * 7/2000 Wilson ..... A63B 69/0048 280/DIG. 8
6,095,952 A * 8/2000 Ali ..... A63B 22/02 482/35
6,231,482 B1 * 5/2001 Thompson ..... A63B 22/02 482/37
2002/0169052 A1 * 11/2002 Godsey ..... A63B 69/0048 482/37
2006/0240949 A1 * 10/2006 Wu ..... A63B 22/001 482/37
2007/0142176 A1 * 6/2007 Brown ..... A63B 22/001 482/7
2008/0293548 A1 * 11/2008 Moy ..... A63B 69/0048 482/36
2010/0016126 A1 * 1/2010 Wu ..... A63B 69/0048 482/37
2011/0240808 A1 * 10/2011 Skipper ..... A63B 21/00047 248/201
2011/0319230 A1 * 12/2011 Brendle ..... A63B 23/03541 482/37
2013/0184124 A1 * 7/2013 Reed ..... A63B 69/0048 482/37
2014/0221163 A1 * 8/2014 McBride ..... A63B 69/0048 482/40
2015/0099613 A1 * 4/2015 Munoz Saez ..... A63B 21/16 482/139
2016/0166874 A1 * 6/2016 Sheeler ..... A63B 21/1627 482/40

FOREIGN PATENT DOCUMENTS

FR 2599633 A1 12/1987
WO WO-9519602 A1 7/1995

OTHER PUBLICATIONS

Written Opinion of the International Searching Authority PCT/ISA/237 for International Application No. PCT/EP2014/002836 dated Feb. 11. 2015.

* cited by examiner

TRAINING APPARATUS, IN PARTICULAR FOR CLIMBING

CROSS-REFERENCE TO RELATED APPLICATIONS

This application is a national phase under 35 U.S.C. §371 of PCT International Application No. PCT/EP2014/002836 which has an International filing date of Oct. 21, 2014, which claims priority to Italy Patent Application No. BZ 2013 A 000052, filed Oct. 23, 2013, the entire contents of each of which are hereby incorporated by reference.

The invention pertains to an item of gymnastic equipment for systematic exercising for the purpose of improving upper body strength, especially for climbing sports.

US 2011/0245040 and EP 0424569 refer to "hangboards" or gripping devices which can be attached preferably in the area of the door lintel of a door opening. The said devices—under the terms "hangboards" or "training boards"—allow dry training, which can also be performed at home, for the purpose of strengthening the upper limbs, especially the muscle complexes of the arms, the shoulders, and the individual fingers for the purpose of enhancing athletic performance for rock-climbing or in climbing gardens fitted with known artificial structures. The said devices are usually permanently mounted to a wall or fixed structure or permanently anchored frame. In order to not obstruct the pronounced swinging motion of the athlete's body while he firmly grasps the equipment's grips, especially when changing grips, the grips are mounted in the area of the lintel of a door opening at a height which allows them to be reached with upraised arms, and/or making a slight jump, as necessary.

The exercising athlete grasps, for a certain time, the grips which the device features; these grips can consist of projecting parts or recesses which can be of a very different design and texture; they can be attached permanently or in such a fashion as to permit them to be easily replaced. The athlete firmly grasping the device can perform simply grasping exercises, pull-ups, and/or practice changing hand grips.

These practice phases during which the athlete exerts himself can be interrupted by rest phase during which the athlete can stand with his feet on the ground.

FR 2599633 refers to different hangboards which can be inserted into a wall-mounted retainer.

WO 95/19602 refers to a climbing wall equipped with different grips which feature an electrical contact which, when used by the athlete, cause corresponding lights to illuminate and/or which store and display in a connected computer the amounts of time which the athlete requires to climb through routes and/or to reach certain positions, i.e., the athlete's physical performance.

DE 102006029309 refers to a climbing wall equipped with sensors and/or actuators which generate an electrical signal, either immediately or with a delay, which triggers an acoustical or optical alarm and/or releases access to an opening, cave, or platform where a prize is located.

The known devices have the disadvantage that the athlete risks overexerting himself and thus injuring his ligaments and/or muscles. In order to prevent such over-exertions and injuries, the athlete must be supported by a coach who assigns him an exercise program which has been adjusted to match the athlete's physical condition, body weight, and performance level. In order to optimize the exercise program, the athlete must be supervised so that the duration of the phases of exertion and rest can be registered and—depending upon the athlete's condition—limits and/or suitable exercise cycles inserted.

The invention has the task of creating a training apparatus of the aforementioned kind which is suitable to prevent the athlete from overexerting himself and to avoid muscle injuries due to overexertion and/or overly lengthy exertion phases—without the need for a coach or assistant.

In order to solve this task, the invention proposes the use of a rigid, oval-shaped hangboard which is equipped with known grips (which can be replaceable) known in the context of "hangboards" or "trainingboards" or artificial climbing walls; this "hangboard" is attached (with vertical play) to a supporting element which can be permanently attached to a wall, e.g., in the area of the lintel of a door opening. The grins are positioned on that part of the moveable hangboard which does not face the wall. In order to vertically lift the hangboard (which is equipped with grips), the device features springs or elastic components which act between the moveable hangboard and the fixed supporting element. When the athlete grasps the grips and suspends himself from them, the springs or elastic components between the moveable hangboard and the fixed supporting element are either compressed or stretched, as the case may be; as a result, the hangboard is lowered vertically slightly. As soon as the athlete is standing with his feet on the ground and releases the grips, the hangboard is pushed or pulled vertically upwards by the springs and/or elastic elements which were compressed or stretched, respectively, during the previous exertion phase.

According to this invention, the acquisition of the said vertical relative motion between the hangboard and the fixed supporting element can be accomplished mechanically by means of a lever or a flexible cable, by means of pressure sensors or electrical contacts, and acquired by a known data acquisition instrument (e.g., a smartphone) capable of registering the number and/or duration of the lowered or raised position of the hangboard and thus to record the number of exertion and rest phases and, possibly, also the duration of the individual phases and to provide a detailed report on the athlete's exercise activities.

Especially in the case of the use of pressure sensors, it is also possible to acquire the athlete's weight and to provide instructions pertaining to the recommended exercise level and/or the maximum level of exertion for complete safety.

In the case of the mechanical transmission of the vertical motion caused by exertion and rest, one or more levers or a cable can be used which act upon a plate or frame which is swivel-mounted on a fixed supporting element of the device; a smartphone can be attached to the said plate or frame in order to register the changes in inclination and, possibly, also the duration of the extreme inclinations of the swivel motion corresponding to the exertion and rest phases.

The invention does not exclude the provision, between the moveable hangboard and the fixed supporting element, of pressure cells containing a fluid and connected via a tube with an acquisition instrument which reacts to variations in pressure of the fluid.

In the case of the acquisition of two swivel positions of the hangboard by means of electrical contacts, they transmit pulses to an electrical counting and, possibly, timing instrument for the purpose of displaying the number and duration of the individual periods of exertion and rest.

One advantage is the mounting of the hangboard in such a manner as to allow its replacement with hangboards with a different arrangement of grips. The grips can be swivel-mounted individually or in groups so as to assume, when in a fixed position, different inclinations with respect to the vertical plane formed by the longitudinal extension of the Moveable hangboard, thus allowing the degree of difficulty of grasping the grips to be changed.

The invention does not exclude the attachment of the supporting element in which the hangboard is mounted in a replaceable manner by means of a horizontal retaining arm at the wall; in this case, the element can be provided with grips on both sides.

Furthermore, the supporting element for the replaceable hangboard can be provided with a vertical, possibly telescopically height-adjustable, retainer for ceiling mounting. In this case, too, the replaceable hangboard can be provided with grips on both sides, or two hangboards can be inserted in the same supporting element. In the case of this design, the compression spring can be inserted between the telescoping parts of the vertical retainer, and the plate with the acquisition instrument can be swivel-mounted to one of the telescoping parts and moved by means of a known mechanism (e.g., a lever, toothed rod, pull cable).

According to a further development of the invention, the supporting element can consist of a simple support plate swivel-mounted to the wall by means of a hinge and which is pressed into position at an angle to the wall by a compression spring between the wall and the rear side of the support plate. In the case of the application of force to the hangboard mounted to the support plate, the compression spring is compressed, and the support plate together with the hangboard are moved towards the wall; at the same time, the acquisition instrument mounted to the same support plate is inclined towards the wall, thus allowing the amount of time during which force is applied to the hangboard to be acquired.

The invention is finally explained in greater detail on the basis of the example schematic designs of a training apparatus according to the invention, especially for climbing sports, included in the attached drawings; in this context, the drawings have a purely explanatory and not a limiting purpose.

Figure 1:
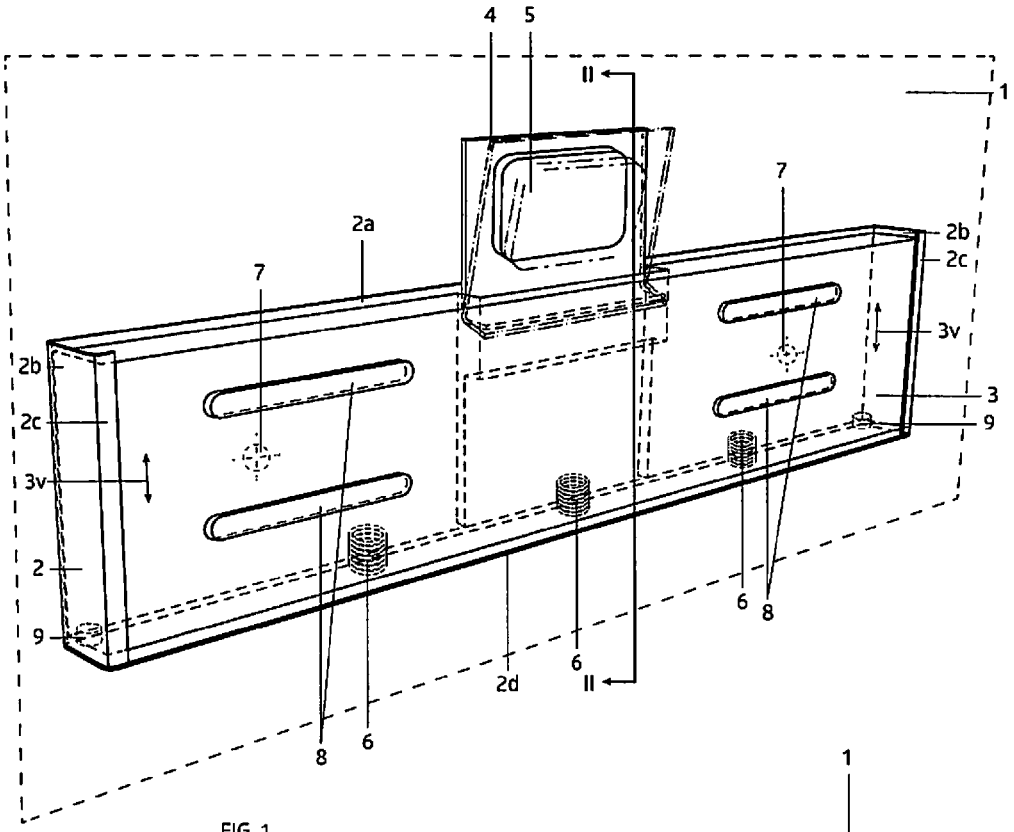
FIG. 1 is a perspective drawing of a training apparatus according to the invention, especially for climbing sports, which is attached to a vertical wall and which is equipped with a swiveling plate for a smartphone.
Figure 2:
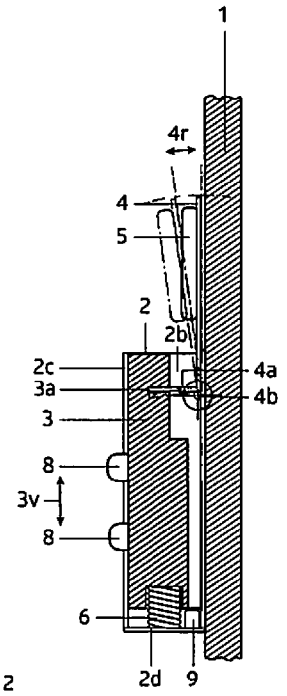
FIG. 2 depicts the cross-section of the vertical sectional plane II-II shown in FIG. 1 which extends through the area with the swiveling plate with smartphone.

At the wall 1, preferably in the area of the lintel of a door opening, the supporting element 2, consisting of a curved metal part, is fixed into place using the dowel 7. This supporting element consists of a rear contact part 2*a* which is in contact with the wall, of the lateral vertical flanges 2*b*, and of the front retaining flanges 2*c*; on the bottom side, a horizontal contact flange 2*d* and an end-stop for a hangboard 3, made, e.g., of wood, with projecting grips 8 are provided. The said hangboard 3 wits the grips 8 is inserted wits a certain amount of play between the lateral flanges 2*b* and the vertical retaining flanges 2*c* of the supporting element 2 in order to be vertically moveable 3*v* with respect to fixed the supporting element 2.

Between the lower horizontal flange 2*d* of the supporting element 2 and the lower flange of the hangboard 3 with the grips 8, compression springs 6 or elastic elements are provided which—as soon as the athlete firmly grasps the grips—are subjected to a force and compressed while the hangboard 3 is slightly lowered. As soon as the athlete releases the grips 8 and is standing with his feet on the ground, the hangboard 3 is moved vertically upwards 3*v* by the expansion of the springs 6 located between the hangboard 3 itself and the fixed supporting element 2—or by the elastic elements.

The vertical motion 3*v* of the hangboard 3 is transmitted to a plate 4 which is swivel-mounted 4*r* and supported 4*b* with its lower horizontal side on the rear contact part 2*a* of the supporting element 2. From the same lower horizontal side of the plate 4, a lever 4*a* projects which forms, together with the plate, an angle of approx. 90° and the free end of which interlocks in a horizontal rill 3*a* which is provided in a corresponding position backwards on the vertically moveable 3*v* hangboard 3. An acquisition instrument 5, consisting of a smartphone, is attached to plate 4; the smartphone is programmed to register the number of changes in the inclination of the swivel 4*r* plate 4 and, if desired, also the duration in the two extreme swivel positions; the exertion and rest phases of the given exercise session can be derived from this.

According to this invention, the motion 3*v* can also be transmitted by means of a cable or a fluid (between the moveable 3*v* hangboard 3 with grips 8 and the fixed supporting element 2) upon which force is applied to the swivel plate 4.

The invention does not exclude the use of the sensors 9 or electrical contacts between the moveable 3*v* hangboard 3 and the fixed supporting element 2 which are connected with known acquisition instruments in order to acquire the number of exertion and rest phases corresponding to the lower and upper position of the hangboard 3 and, if desired, also their duration. The same sensors or specific sensors can also display the body weight of the exercising athlete. The invention does not exclude a wireless connection between the sensors activated by the hangboard 3 and the acquisition instrument.

Of course, all of the registered data—together with the athlete's entered personal data—can be processed using stored programs in the same smartphone in order to provide the athlete with personalized exercise goals, together with the entry of data reflecting borderline situations which, if exceeded, could result in injury, damages, or negative exercise situations.

The invention does not exclude the use of tension springs or of elastic tension components in lieu of the compression springs 6 between the moveable 3*v* hangboard 3 and the supporting element 2.

Additionally, the invention does not exclude the swivel attachment, using a single retainer, of individual grips or several identical or different grips 8 to the hangboard 3 in order to change the inclination with respect to the fastening surface at the moveable 3*v* hangboard 3 and thus to vary the characteristics and the degree of difficulty of grasping the grips. The said inclination can be displayed directly at the device or represented by a coefficient indicating the degree of difficulty; this coefficient shall correspondingly influence, when entered into the processing program of the smartphone or corresponding electronic computer, the installed exercise program.

It is an advantage that the hangboard 3 can be easily dismounted by simply pulling it up and out of the fixed supporting element 2 so as to be replaced by a hangboard 3 equipped with different grips and/or a different arrangement of grips.

Figure 3:
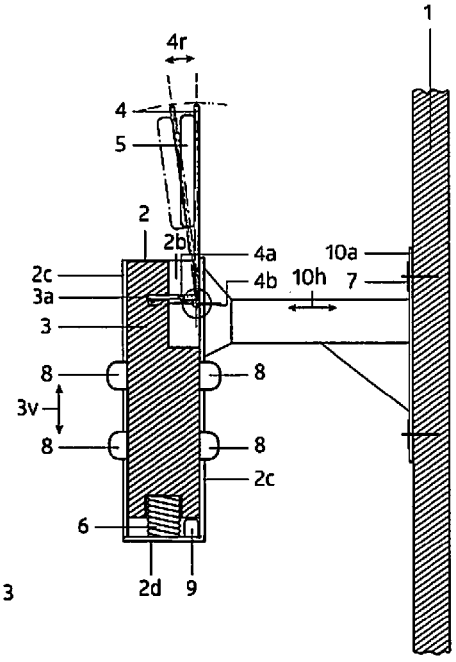
FIG. 3 depicts the same cross-section shown FIG. 2 of the training apparatus according to the invention, with the hangboard equipped with grips on both sides and with the horizontal retainer for the spaced wall montage.

In order to allow the athlete to grasp, if desired, both sides of the hangboard 3, the hangboard—because it is equipped on both sides with grips 8—can be mounted in a possibly variable distance to the wall 1 using a horizontal retainer 10*h* with the mounting plate 10*a* (FIG. 3).

Figure 4:
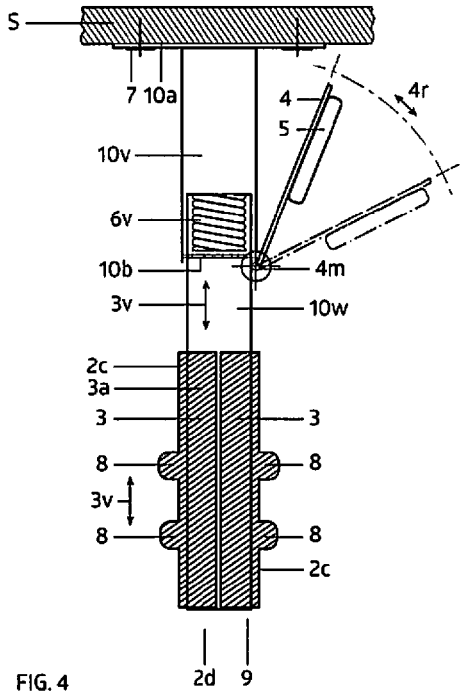
FIG. 4 depicts the cross-section of two hangboards mounted wits their rear sides against each other, with a vertical telescoping retainer for ceiling mounting.

Either a hangboard 3 equipped with grips 8 on both sides or two hangboards 3 mounted back-to-back can also be mounted on the ceiling S using a vertical telescoping retainer 10*v*, 10*w* (FIG. 4). In this case, a compression spring 6*v* can be mounted between the parts 10*v* and 10*w* of the telescoping retainer, and the plate 4 for the acquisition instrument 5 can swivel-mounted 4*r* by means of a hinge 4*m* to one of the telescoping parts 10*v*, 10*w* and activated by a known mechanism—e.g., by means of a lever, toothed rod, or pull cable.

Figure 5:
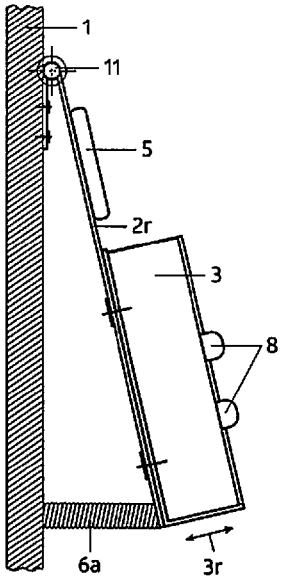
FIG. 5 depicts a wall-mounted support plate with swivel retainer and with a hangboard and acquisition instrument mounted on it so as to be immovable.

The supporting element 2 can be replaced by a simple support plate 2*r* which is swivel-mounted to the upper horizontal longitudinal edge by means of a hinge 11 to the wall 1 or to a mounting arm; with a compression spring 6*a* placed in between, and swivel-mounted 3*r*; in this case, whether the hangboard 3 or the acquisition instrument 5, it can be mounted directly to the support plate 2*r* (FIG. 5).

The invention claimed is:

1. A training apparatus comprising:

a supporting element including a protruding flange, the supporting element configured to be attached to one of a wall and a permanent fixed structure;

a hangboard including, grips, each of the grips having a different shape than other ones of the grips, the grips being one of a projecting part and a recess, and the grips being configured to be grasped by an athlete with extended arms in order to suspend the athlete's body from the grips without touching one of earth and a floor, the hangboard being vertically moveable in the supporting element, the protruding flange acting as a lower end-stop for the hangboard; and at least one of a spring or an elastic component between the supporting element and the hangboard, the at least one of the spring or the elastic component configured to at least one of press or pull the hangboard upwards; and an electronic interface configured to acquire positions of the hangboard, the electronic interface connected with the hangboard at least one of mechanically, electrically, hydraulically, or pneumatically.

2. The training apparatus in accordance with claim 1, wherein the electronic interface is a smartphone, the smartphone is configured to register a duration of individual phases of exertion and rest, the smartphone being programmable with onboard data storage and display of acquired and processed data.

3. The training apparatus in accordance with claim 1, wherein the electronic interface is a smartphone, transmission of a vertical movement of the hangboard to the smartphone is effected mechanically by at least one lever, the at least one lever being swivel-mounted to and supported by the supporting element, and the free end of the at least one lever being interlocked with the hangboard.

4. The training apparatus in accordance with claim 1, wherein the electronic interface is a smartphone, transmission of a vertical movement of the hangboard to the smartphone is effected by a flexible cable, the flexible cable being attached on one end to the hangboard and on a second end to the smartphone, the smartphone being swivel-mounted to one of the supporting element or the wall.

5. The training apparatus in accordance with claim 1, wherein the electronic interface is a smartphone, transmission of a vertical movement of the hangboard to the smartphone is effected via a fluid inside of a tube.

6. The training apparatus in accordance with claim 1, wherein a vertical movement of the hangboard is registered by at least one of electrical contacts and pressure sensors which are connected to the smartphone via one of conductors, a radio, or light impulses.

7. The training apparatus in accordance with claim 1, wherein:

the hangboard is configured to be dismounted and replaced, and the grips can be attached with different inclinations crosswise to the longitudinal extension of the moveable hangboard.

8. The training apparatus in accordance with claim 1, wherein the supporting element is mounted to the wall at a given distance by a retainer, the retainer is a horizontal retainer, and the retainer is adjustable.

9. The training apparatus in accordance with claim 1, wherein the supporting element is mounted to a ceiling by at least one of a single-piece retainer or a telescoping retainer, the hangboard is permanently attached to a lower part of the telescoping retainer, a compression spring is mounted between telescoping parts; and the plate is swivel-mounted to one of the telescoping parts and is driven by a lever, toothed rod, or pull cable.

10. A training apparatus comprising:

a support plate configured to be attached to one of a wall and a permanent fixed structure;

a hangboard including, grips, each of the grips having a different shape than other ones of the grips, the grips being one of projecting part or a recess, and the hangboard being vertically moveable; and at least one of a spring or an elastic component between the support plate and the hangboard, the at least one of the spring or the elastic component configured to at least one of press or pull the hangboard upwards; and an electronic interface configured to interface with the hangboard and acquire position information for the hangboard, the hangboard and the electronic interface being fixed to the support plate, the support plate being swivel-mounted to the one of the wall and the permanent fixed structure by a hinge, and the at least one of the spring and the elastic component between the support plate and the one of the wall and the permanent fixed structure.

11. A training apparatus comprising:

a supporting element configured to be attached to a wall, the support element including, an end-stop at a bottom portion of the supporting element;

a hangboard supported by the supporting element, the hangboard being vertically moveable along the supporting element, the hangboard including, grips, each of the grips having a different shape than other ones of the grips, the grips being one of a projecting part or a recess; and an elastic component between the supporting element and the hangboard, the elastic component configured to bias the hangboard upwards.

* * * * *